US006729029B1

(12) United States Patent
Chu

(10) Patent No.: US 6,729,029 B1
(45) Date of Patent: May 4, 2004

(54) CLASP KNIFE

(76) Inventor: Chi-Tung Chu, No. 9, Alley 7, Lane 118, Syh-Wei Rd., Wu-Ku Hsiang, Taipei Hsien (TW)

( * ) Notice: Subject to any disclaimer, the term of this patent is extended or adjusted under 35 U.S.C. 154(b) by 32 days.

(21) Appl. No.: 10/269,563

(22) Filed: Oct. 11, 2002

(51) Int. Cl.[7] ..... B26B 1/04

(52) U.S. Cl. ..... 30/161; 30/155; 30/342; 30/157

(58) Field of Search ..... 30/161, 153, 155, 30/157, 160, 331, 342, 337, 338

(56) References Cited

U.S. PATENT DOCUMENTS 1,603,914 A * 10/1926 Hermann ..... 30/157
4,148,140 A * 4/1979 Lile ..... 30/161
4,893,409 A * 1/1990 Poehlmann ..... 30/161
5,092,045 A * 3/1992 Boyd et al. ..... 30/161
5,822,866 A * 10/1998 Pardue ..... 30/161
5,915,792 A * 6/1999 Sakurai ..... 30/161
6,079,106 A * 6/2000 Vallotton ..... 30/161
6,105,255 A * 8/2000 Cheng ..... 30/161
6,397,477 B1 * 6/2002 Collins ..... 30/161
6,430,816 B2 * 8/2002 Neveux ..... 30/161
2002/0104220 A1 * 8/2002 Marfione ..... 30/160
2002/0157260 A1 * 10/2002 Cheng ..... 30/161
2003/0070299 A1 * 4/2003 Frazer ..... 30/161

* cited by examiner

*Primary Examiner*—Boyer D. Ashley
(74) *Attorney, Agent, or Firm*—Dellett & Walters

(57) ABSTRACT

A clasp knife is composed of a handle and a blade pivotally mounted on the handle. The handle has a fastening member and a locking member provided therein. The blade has a taper hole, a tongue slot, and a locking surface. When the blade is received in the handle, the fastening member is positioned in the taper hole and the locking member can abut the locking surface of the blade, so that the blade cannot be freely pivoted outwards to extend from the handle without the operation of the user. When the blade is extended, the locking member can be inserted in the tongue slot to prevent the blade from freely pivoting.

10 Claims, 7 Drawing Sheets

CLASP KNIFE

BACKGROUND OF THE INVENTION

1. Field of the Invention

The present invention is related to a clasp knife, and more particularly to a knife of which a blade is safely locked in a handle and will not freely pivot in an undesired manner.

2. Description of Related Art

Referring to FIGS. 6 and 7, a conventional clasp knife includes a handle (60) being composed of a first part (61) and a second part (62) assembled together, and a blade (70) pivotally mounted on the handle (60). A pivot pin (63) is provided on the second part (62) of the handle (60), by which an installed portion (71) of the blade (70) is pivotally mounted between the first part (61) and the second part (62).

The blade (70) has a cutting edge and a back opposite to the cutting edge. A lug (72) is formed on a top surface and adjacent the back of the blade (70). When the blade (70) is received in the handle (60), the lug (72) is located outside the handle (60), by which a user can extend the blade (70) very easily.

A flexible sheet (64) is mounted on the second part (62), and has a free end (641) adjacent the pivot pin (63) and a fixed end (not numbered) secured on the second part (62). The blade (70) has a notch (73) defined at a rear end thereof. When the blade (70) is extended, the free end (641) is erected to locate in the notch (73), and presses against the installed portion (71) to prevent the blade (70) from freely pivoting.

A protrusion (65) is formed on the flexible sheet (64) and positioned in a recess (74) defined on a bottom surface of the blade (70) when the blade (70) is received in the handle (60), so that the blade (70) is fastened in the handle (60) and cannot freely pivot.

However, by only using the protrusion (65) positioned in the recess (74), the blade (70) cannot surely fastened in the handle (60) and may freely pivot out to injure a user.

Therefore, the invention provides a clasp knife to mitigate and/or obviate the aforementioned problems.

SUMMARY OF THE INVENTION

The main objective of the invention is to provide a clasp knife of which a blade can be surely fastened in a handle and will not freely pivot without an operation of a user.

Other objects, advantages and novel features of the invention will become more apparent from the following detailed description when taken in conjunction with the accompanying drawings.

DETAILED DESCRIPTION OF THE PREFERRED EMBODIMENT

Figure 1:
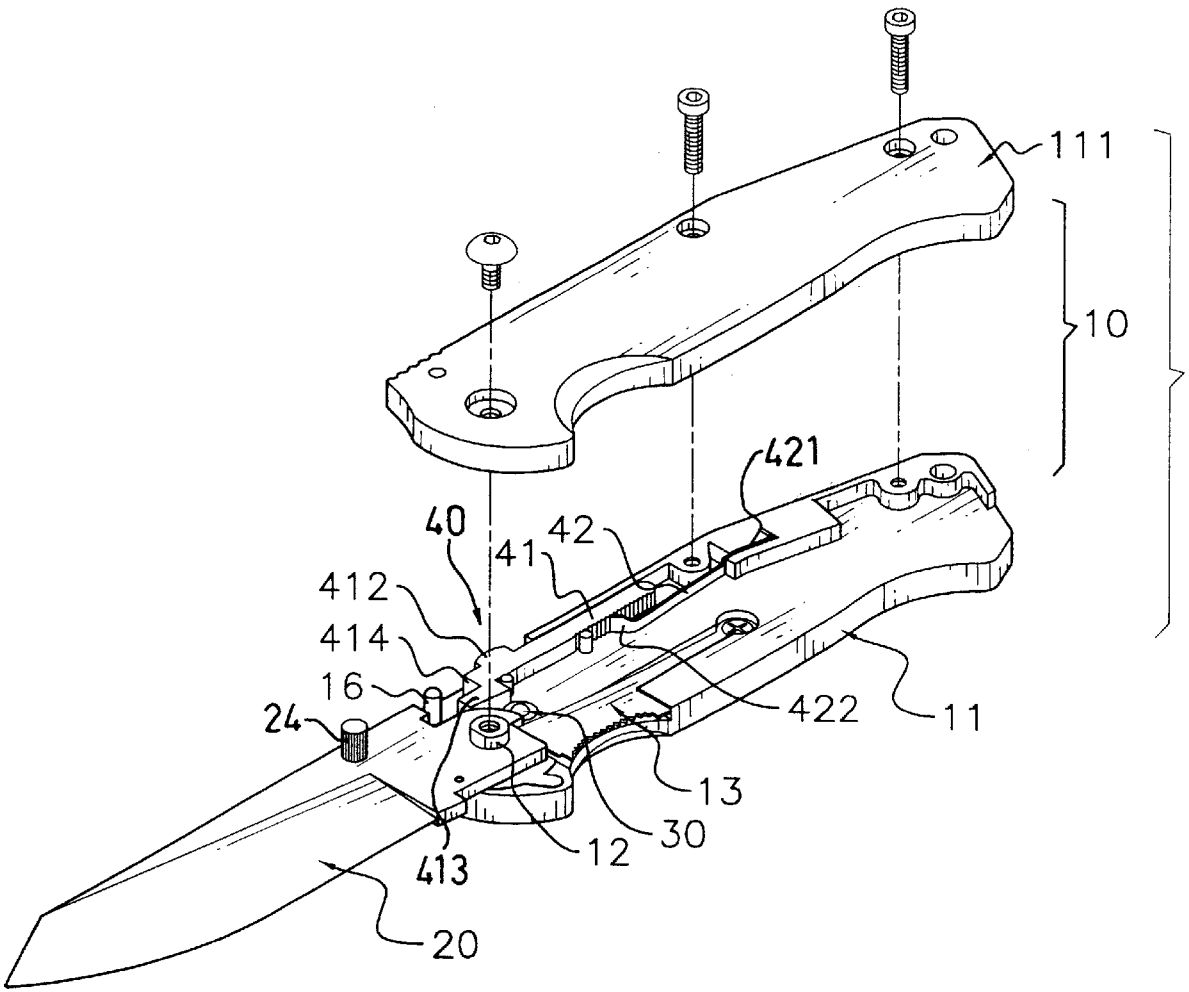
FIG. 1 is a perspective view of a clasp knife in accordance with the invention having part of a handle removed for clarity.
Figure 2:
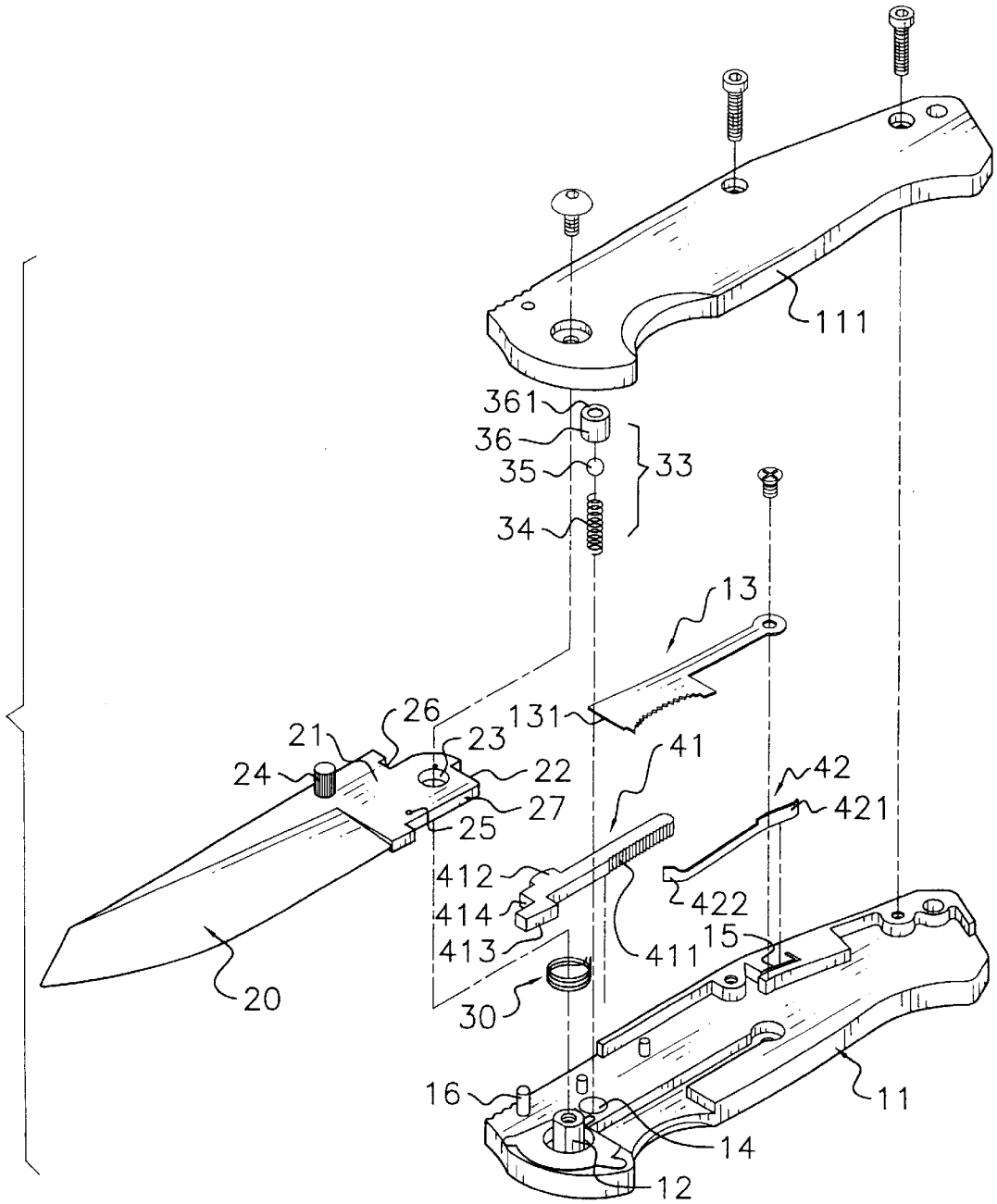
FIG. 2 is an exploded perspective view of the clasp knife of FIG. 1.
Figure 3:
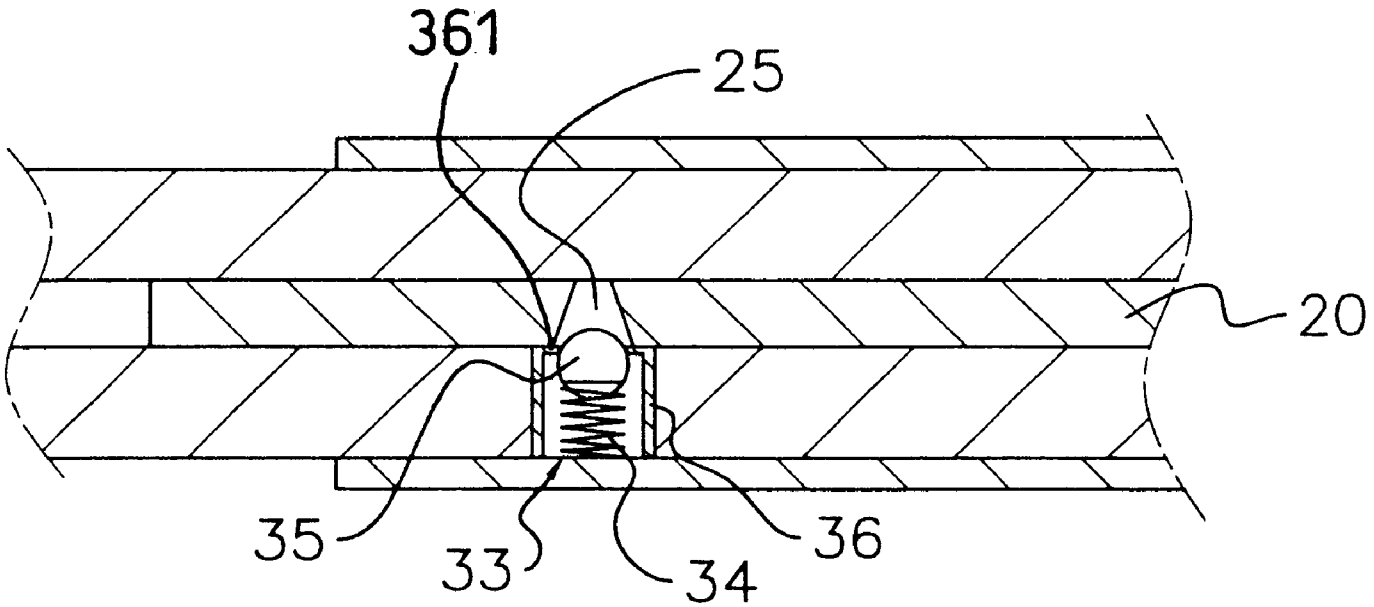
FIG. 3 is a partially sectional view showing a blade of the knife being locked by a fastening member of the handle.

Referring to FIGS. 1–3, a clasp knife in accordance with the invention is composed of a handle (10) and a blade (20).

The handle (10) has a first part (111) and a second part (11) assembled by fasteners (not numbered). The handle (10) has a gap between the first part (111) and the second part (11) for receiving the blade (20).

The second part (11) has an inner side by which the lade (20) is received in the handle (10), an outer side opposite to the inner side, a front end and a rear end. A pivot pin (12) is provided at th e front end of the second part (11), and a flexible sheet (13) is provided on the second part (11) and located in the gap. The flexible sheet (13) has a fixed end (not numbered) away from the pivot pin (12) secured on the second part (11), and a free end (not numbered) adjacent the pivot pin (12) and erected from the second part (11). The flexible sheet (13) has a flat front edge (131) formed at the free end thereof for pressing against the blade (20).

The second part (11) further has an aperture (14) defined be side the flexible sheet (13), a stop (16) formed adjacent the outer side and the front end of the second part (11), and an L-shaped slot (15) defined adjacent the outer side and the rear end of the second part (11).

The blade (20) has an installed portion (21), a cutting edge (not numbered) and a back (not numbered) opposite to the cutting edge. The installed portion (21) has a pin hole (23) defined therethrough and the pivot pin (12) is inserted through the pin hole (23) to pivotally mount the blade (20) between the first part (111) and the second part (11). The blade (20) can be pivoted inwards to receive in the gap between the first part (111) and the second part (11). A notch (22) is defined at a rear end of the installed portion (21). When the blade (20) is extended, the erected free end of the flexible sheet (13) can be located in the notch (22) and the flat front edge (131) presses against the installed portion (21). A taper hole (25), which is tapered from a bottom surface to a top surface of the blade (20), is defined in the installed portion (21) and aligned with the aperture (14) in the second part (11) when the blade (20) is received in the handle (10).

A lug (24) is formed on the top surface of the blade (20) and adjacent the back of the blade (20). When the blade (20) is received in the handle (10), the lug (24) is located outside the handle (10) and a user can grasp the lug to extend the blade (20) very easily.

A torsional spring (30) is provided outside the pivot pin (12), wherein a first end of the torsional spring (30) is secured on the second part (11) of the handle (10), and a second end of the torsional spring (30) is secured on the installed portion (21) of the blade (20). The torsional spring (30) provides a small elastic force for assisting the user to extend the blade (20).

A fastening member (33) is provided in the aperture (14) of the second part (11) to lock the blade (20) when the blade (20) is received in the handle (10). The fastening member (33) is composed of a resilient member (34), a ball (35), and a sleeve (36). The sleeve (36) is received in the aperture (14), and has an opening (361), of which a diameter is smaller than a diameter of the ball (35), defined at an upper end of the sleeve (36). The ball (35) is received in the sleeve (36), and pushed by the resilient member (34) provided under the ball (35) to partially extend from the opening (361). The extending part of the ball (35) is received in the tapered hole (25), and the blade (20) is locked in the handle (10) by the ball (35), as specially shown in FIG. 3.

Figure 5:
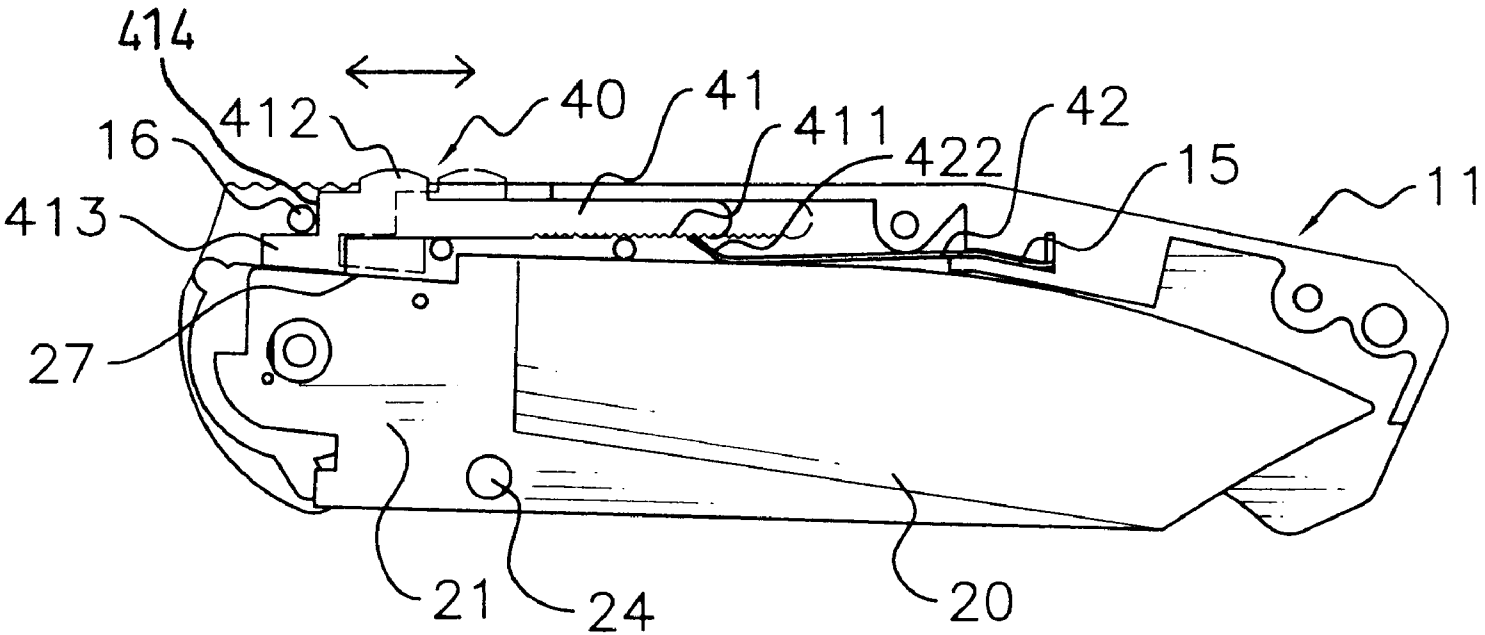
FIG. 5 is a side view of the knife in which the blade is folded in the handle.
Figure 6:
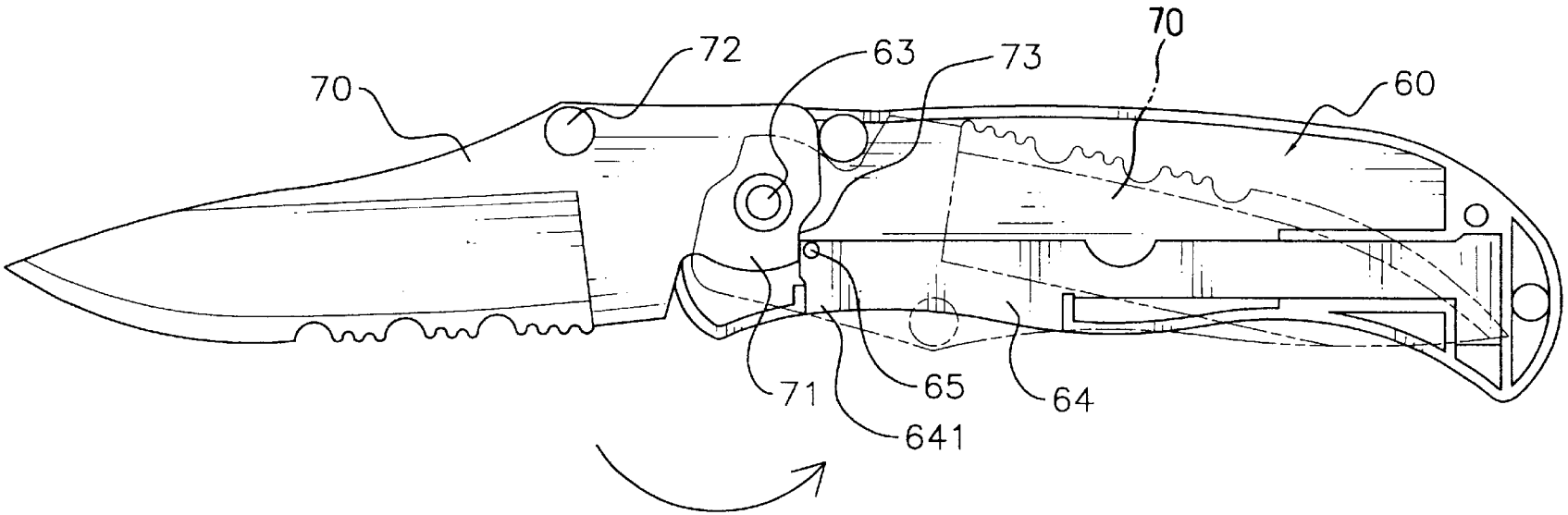
FIG.6 PRIOR ART
FIG. 6 is a side view of a conventional clasp knife.
Figure 7:
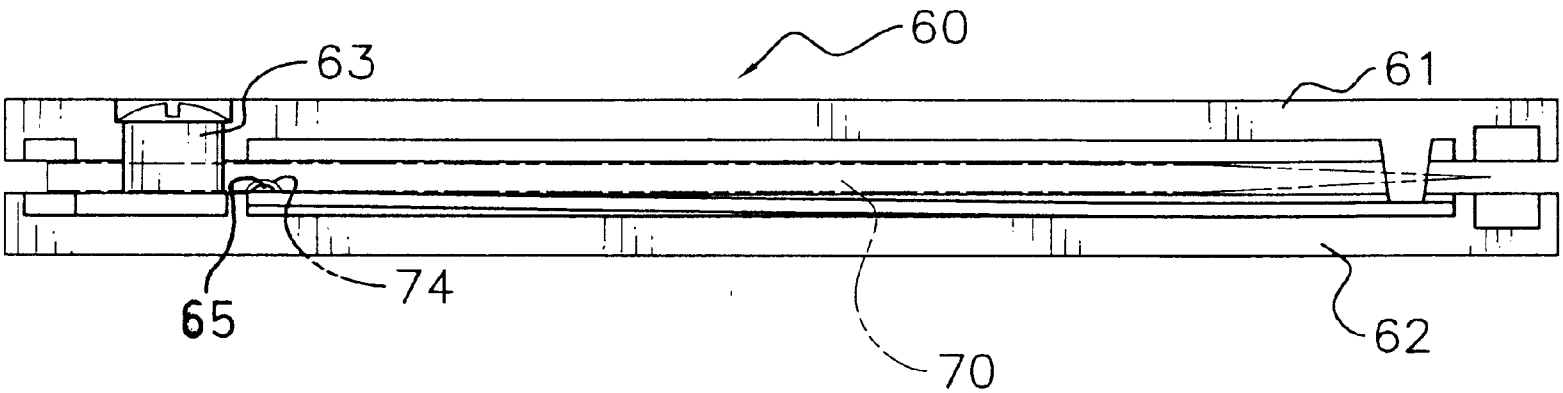
FIG.7 PRIOR ART
FIG. 7 is a bottom view of the conventional clasp knife in a folded status.

Therefore, referring to FIGS. 3 and 5, for receiving the blade (20), the user can pivot the blade (20) towards the handle (10), and the free end of the flexible sheet (13) is pressed under the blade (20). When the blade (20) is received in the handle (10), the ball (35) is positioned in the taper hole (25) under the force of the resilient member (34), so that the blade (20) is fastened in the handle (10) and will not freely extend out from the handle (10).

Figure 4:
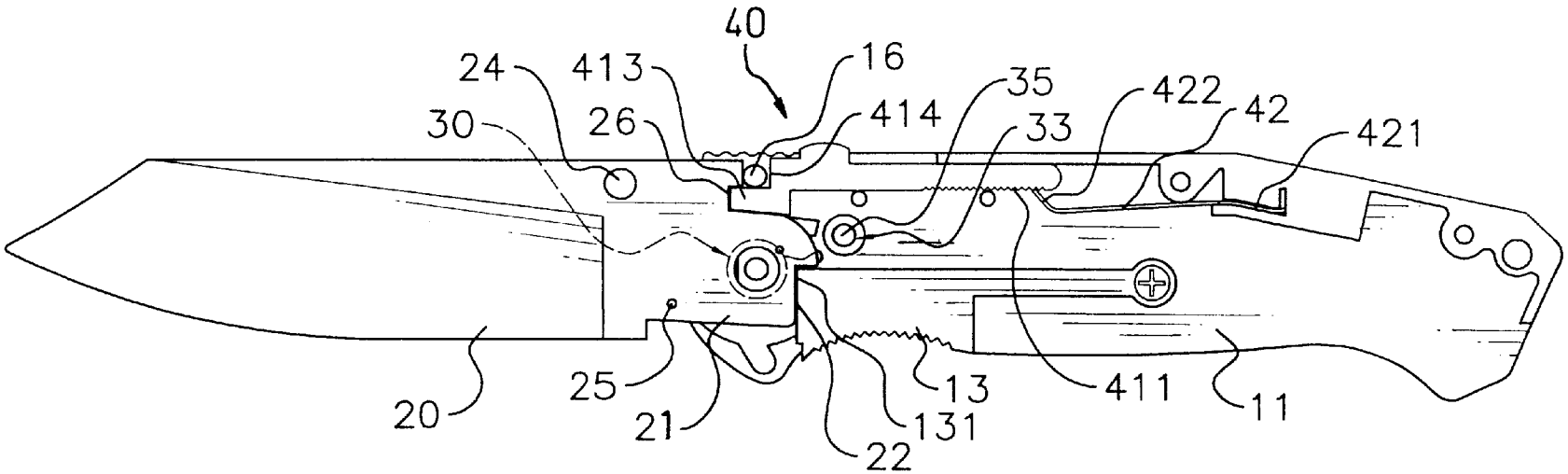
FIG. 4 is a side view of the knife in which the blade is extended.

Referring to FIG. 4, for extending the blade (20), the user can grasp the lug (24) to pivot the blade (20) outwards. The ball (35) is pressed downwards by the taper hole (25) to retract in the sleeve (36) to release the blade (20), and the torsional spring (30) provides a further force to assist the blade (20) to extend out. When the blade (20) is extended completely, the free end of the flexible sheet (13) is erected again and located in the notch (22), and the flat front edge (131) presses against the installed portion (21) to prevent the blade (20) from freely pivoting.

Referring back to FIGS. 1 and 2, the clasp knife of the present invention has a locking member (40) for further locking the blade (20), which is composed of a locking piece (41) movably provided on the second part (20) and a flexible strip (42) securely mounted in the L-shaped slot (15).

The locking piece (41) has a plurality of teeth (411) formed at a rear end thereof and on a side surface facing the inner side of the second part (20). An ear (412) is formed on a side surface of the locking piece (41) facing the outer side of the second part (20), and is protruded from the handle (10). The user can push the ear (412) to move the locking piece (41). A tongue (413) is formed at a front end of the locking piece (41), and a step (414) is formed between the ear (412) and the tongue (413).

The flexible strip (42) has a first end (421) secured in the L-shaped slot (15), and a second end (422) engaged with one of the teeth (411) to position the locking piece (41) under the elastic force of the flexible strip (42). It is noted that the elastic force of the flexible strip (42) can not block the locking piece (41) to move when the user pushes the ear (412).

For matching the locking member (40), the blade (20) further has a tongue slot (26) defined in the installed portion (21) and aligned with the tongue (413) of the locking piece (41) when the blade (20) is extended, and a locking surface (27) formed at a side of the installed portion (21) opposite to the back of the blade (20).

Referring to FIGS. 2 and 4, when the blade (20) is in the extended status, the locking piece (41) is moved towards the blade (20) to insert the tongue (413) in the tongue slot (26), and the second end (422) of the flexible strip (42) is engaged with one of the teeth (411) to position the locking piece (41). Therefore, the blade (20) cannot be pivoted to receive in the handle (10) unless the tongue (413) is retracted from the tongue slot (26).

Referring to FIG. 5, when the blade (20) is received in the handle (10), the step (414) abuts the stop (16), and the locking piece (41) is positioned by the flexible strip (42). In this case, the locking surface (27) of the blade (20) is blocked by the tongue (413), so that the blade (20) cannot be pivoted to extend from the handle (10).

From the above description, it is noted that the invention has the following vantages:

1. By using the fastening member to position in the taper hole, the blade cannot freely pivoted outwards to extend from the handle without the operation of the user.
2. The locking member can provide a further locking effect for the blade ether in an extended status or a folded status.

It is to be understood, however, that even though numerous characteristics and advantages of the present invention have been set forth in the foregoing description, ether with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A clasp knife comprising:

a handle (10) being composed of a first part (111) and a second part (11) assembled together, and having a gap between the first part (111) and the second part (11) for receiving a blade (20), the second part (11) having a pivot pin (12) provided at a front end of the second part (11), and a flexible sheet (13) located in the gap of the handle (10) and adjacent an inner side of the second part (11) by which the blade (20) is received in the handle (10), the flexible sheet (13) having a fixed end away from the pivot pin (12) secured on the second part (11) and a free end adjacent the pivot pin (12);

the blade (20) pivotally mounted between the first part (111) and the second part (11), and having a cutting edge, a back opposite to the cutting edge, an installed portion (21) pivotally mounted on the pivot pin (12), and a taper hole (25) tapered from a bottom surface to a top surface of the blade (20) defined through the installed portion (21), the free end of the flexible sheet (13) abutting a rear end of the installed portion (21) when the blade (20) is extended;

a torsional spring (30) provided outside the pivot pin (12), the torsional spring (30) having two free ends respectively secured on the second part (11) of the handle (10) and the installed portion (21) of the blade (20);

a fastening member (33) provided in the second part (11) and attached in the taper hole (25) when the blade (20) is received in the handle (10) to fasten the blade (20); and a locking member (40) movably mounted at an outer side opposite to the inner side of the second part (11) for locking the blade (20), which prevents the blade (20) from freely pivoting without an operation of a user.

2. The clasp knife as claimed in claim 1, wherein the flexible sheet (13) has a flat front edge (131) formed at the free end thereof, the blade (20) has a notch (22) defined at the rear end of the installed portion (21), and the flat front edge (131) is located in the notch (22) and abuts the installed portion (21) when the blade (20) is extended.

3. The clasp knife as claimed in claim 1, wherein the blade (20) has a pin hole (23) defined through the installed portion (21), and the pivot pin (12) is inserted through the pin hole (23).

4. The clasp knife as claimed in claim 1, wherein the blade (20) has a lug (24) formed on the top surface and adjacent the back of the blade (20), and located outside the handle (10) when the blade (20) is received in the handle (10).

5. The clasp knife as claimed in claim 1, wherein the second part (11) has an aperture (14) defined therein and aligned with the taper hole (25) when the blade (20) is received in the handle (10), and the fastening member (33) is provided in the aperture (14).

6. The clasp knife as claimed in claim 5, wherein the fastening member (33) has a sleeve (36) received in the aperture (14) with an opening (361) defined at a top end of the sleeve (36), a ball (35) received in the sleeve (36) with a diameter larger than a diameter of the opening (361), and a resilient member (34) provided beneath the ball (35) to push the ball (35) partially extending out from the opening (361).

7. The clasp knife as claimed in claim 1, wherein the second part (11) has an L-shaped slot (15) defined adjacent the outer side thereof, and the locking member (40) has a locking piece (41) having a plurality of teeth (411) formed on a side surface facing the inner side of the second part (11), an ear (412) formed on a side surface facing the outer side of the second part (11) and protruded from the outer side, a tongue (413) formed at a front end of the locking piece (41), and a step (414) formed between the ear (412) and the tongue (413), and a flexible strip (42) having a first end (421) fastened in the L-shaped slot (15), and a second end (422) engaged with one of the teeth (411).

8. The clasp knife as claimed in claim 7, wherein the blade (20) has a tongue slot (26) defined in the installed portion (21), and the tongue (413) is aligned with and inserted in the tongue slot (26) when the blade (20) is extended.

9. The clasp knife as claimed in claim 7, wherein the blade (20) has a locking surface (27) formed at a side of the installed portion (21) opposite to the back of the blade (20), and the tongue (413) can abut the locking surface (27) when the blade (20) is received in the handle (10).

10. The clasp knife as claimed in claim 9, wherein the second part (11) has a stop (16) formed adjacent the outer side and the front end of the second part (11), and the step (414) can abut the stop (16) when the blade (20) is received in the handle (10).

* * * * *